US007788825B2

(12) United States Patent
Gratadour et al.

(10) Patent No.: US 7,788,825 B2
(45) Date of Patent: Sep. 7, 2010

(54) SHOE, IN PARTICULAR SPORTS SHOE, WITH INTERNAL SHOCK-ABSORBING ELEMENT FOR THE HEEL

(75) Inventors: Vincent Gratadour, La Madeleine (FR); Laurent Baly, Lille (FR)

(73) Assignee: Decathlon, Villeneuve d'Ascq (FR)

( * ) Notice: Subject to any disclaimer, the term of this patent is extended or adjusted under 35 U.S.C. 154(b) by 852 days.

(21) Appl. No.: 11/636,641

(22) Filed: Dec. 11, 2006

(65) Prior Publication Data

US 2007/0186445 A1 Aug. 16, 2007

(30) Foreign Application Priority Data

Feb. 10, 2006 (FR) ..... 06 01208

(51) Int. Cl.
*A43B 13/18* (2006.01)
*A43B 21/28* (2006.01)

(52) U.S. Cl. ..... 36/28; 36/35 R; 36/35 B

(58) Field of Classification Search ..... 36/28, 36/35 R, 35 B, 3 B, 29
See application file for complete search history.

(56) References Cited

U.S. PATENT DOCUMENTS

2005/0022426 A1 2/2005 Clark et al.
2005/0241082 A1 * 11/2005 Moretti ..... 36/3 B
2006/0117605 A1 * 6/2006 Michaeli ..... 36/29

FOREIGN PATENT DOCUMENTS

DE 195 09 636 A1 9/1996
FR 2 438 983 A 5/1980
FR 2 732 197 A 10/1996

* cited by examiner

*Primary Examiner*—Ted Kavanaugh
(74) *Attorney, Agent, or Firm*—Kenyon & Kenyon LLP

(57) ABSTRACT

A shoe, in particular a sports shoe, includes an inner sole and an outer sole the heel part of which, hollowed out with an opening oriented upwards, includes an internal shock-absorbing element, which is preferably formed as a single block with the outer sole. This shock-absorbing element has a hollow tubular open configuration, the annular section of which is not of constant thickness over all of its height, locally presenting a zone of reduced thickness, from which preferably the deformation by flexing of the shock-absorbing element occurs. Preferably, it has an outer wall that is perpendicular to the general pressure plane of the outer sole and an inner wall with a concave curvature.

11 Claims, 2 Drawing Sheets

SHOE, IN PARTICULAR SPORTS SHOE, WITH INTERNAL SHOCK-ABSORBING ELEMENT FOR THE HEEL

FIELD OF THE INVENTION

This present invention concerns the area of shoes, in particular sports shoes. More particularly, it concerns a shoe whose outer sole includes, in its heel part, an internal shock-absorbing element intended to protect the heel from shock, such as when playing court games, for example. During movement, a very large majority, of the order of 75%, of the weight of the user is placed on the calcaneum or heelbone. This proportion increases still further during the practice of certain sports. As a consequence, the manufacturers of sports shoes take great care to ensure the protection of the calcaneum from the shock to which the latter can be subjected during the practice of sports.

BACKGROUND OF THE INVENTION

Most sports shoes now include at least one shock-absorbing element placed in the heel part of the shoe, under the calcaneum. This shock-absorbing element is generally an independent element, with increased elasticity, placed inside the outer sole. However, it can nevertheless be incorporated into the said sole.

In document FR.2.438.983, the shock-absorbing element is located between the inner sole of the shoe and the outer sole proper, and is made from a rubber or plastic material that is characteristic of a high-level shock-absorber. In one example of implementation, the outer sole is made from a cellular material whose elasticity and shock-absorbing properties allow the design of the shock-absorbing element and of the said outer sole as a single part. This shock-absorbing element takes the form of a vertical hollow cylinder that bears upon the base of the outer sole proper, at the level of an annular groove formed in the latter. The inner sole rests on the top edge of the tubular shock-absorbing element.

In this method of implementation, the outer sole into which the shock-absorbing element is incorporated is made from a rubber or plastic material that is characteristic of a high-level shock-absorber. It therefore cannot be a conventional outer-sole material, and this can have drawbacks in relation to resistance to wear or abrasion of the outer sole.

SUMMARY OF THE INVENTION

The objective of this present invention is to propose a shoe, in particular a sports shoe, whose outer sole can include, as in the above variant of document FR 2.438.983, a built-in tubular shock-absorbing element, which overcomes the aforementioned drawback and/or which however has a different structure.

This is a shoe that includes an inner sole and an outer sole and whose heel part is hollow with a suitable opening and includes an internal shock-absorbing element.

In a manner which is characteristic of this present invention, the shock-absorbing element, preferably forming a single block with the outer sole, has a hollow tubular configuration whose annular section is not of constant thickness over all of its height, presenting locally a zone of reduced thickness, from which the deformation, by flexing of the shock-absorbing element, preferably occurs. Thus the shock-absorbing effect, at the heel, is obtained due to the deformation, by flexing or flexing, of the hollow tubular element, this therefore occurring in the zone of the shock-absorbing element which presents a locally reduced thickness that develops toward the exterior of the shock-absorbing element.

In an implementation variant, the outer wall of the tubular shock-absorbing element is perpendicular to the general pressure plane of the outer sole, while its inner wall has a concave curvature. The expression "general pressure plane" refers to the plane of the inner face of the outer sole in the heel part, which comes into contact with the ground. Because of the concave curvature of its inner wall, the shock-absorbing element has an annular section whose thickness varies progressively from its top edge to its bottom edge, with this variation decreasing from its top edge to the zone of reduced thickness, and then increasing to the bottom edge.

In one method of implementation, the radius of curvature of the concave inner wall is of the order of 6 to 10 mm, and the zone of reduced thickness is approximately at mid-height of the shock-absorbing element.

In an implementation variant, the opening of the tubular shock-absorbing element is oriented upwards, and the said shoe includes a flexible disk in a plastic material, at least partially closing off the opening of the heel part and resting on the top edge of the shock-absorbing element.

In this case, the shock-absorbing effect, at the heel, is achieved by the combination firstly of the deformation, by flexing, of the tubular shock-absorbing element, and secondly of a suspension effect caused by the deformation of the flexible disk during the vertical pressure applied by the calcaneum along the vertical axis of symmetry of the hollow tubular shock-absorbing element, with this deformation curving the said disk inwards toward the interior of the shock-absorbing element.

According to one method of implementation of this variant, the portion of outer sole that constitutes the bottom of the shock-absorbing element has a concave configuration, and a thickness that is approximately constant. As a result, the central zone of the bottom of the shock-absorbing element is raised in relation to the general pressure plane of the outer sole.

Particularly in this last method of implementation, it is preferable that the portion of outer sole constituting the bottom of the shock-absorbing element should be fully displaced in height in relation to the general pressure plane of the said outer sole. Thus, the portion of sole constituting the bottom of the shock-absorbing element cannot under any circumstances constitute an impediment to the deformation of the tubular shock-absorbing element. In particular, given that the tubular element is hollow, it constitutes a sort of air chamber with the flexible disk that covers it. During the impact of the calcaneum, the suspension effect deforms the flexible disk that constitutes the upper wall of this air chamber, which in turn causes an increase in the pressure of the air trapped inside the said chamber, with correlative deformation of the portion of outer sole constituting the bottom of the said chamber and therefore the bottom of the shock-absorbing element.

The flexible disk can be pierced with at least one through hole, which gives onto the inner space of the tubular shock-absorbing element, with this space corresponding to the internal volume of the air chamber. This through hole allows the air chamber to reach a pressure equilibrium during the lifting of the foot of the user in relation to the inner sole, at least partially.

The tubular shock-absorbing element preferably has a height of 13 to 15 mm, a thickness in cross section of 4 to 5 mm at its top edge, and a thickness in cross section of 2 to 3 mm in the zone of reduced thickness.

The zone of reduced thickness is preferably at a distance of 5 to 6 mm from the top edge of the shock-absorbing element.

The flexible disk in a plastic material is in fact preferably in rubber, and has a thickness of 3 mm.

According to one method of implementation, the flexible disk in a plastic material partially closes off the opening of the heel part and is positioned under the inner sole, which itself covers the whole of the opening in the heel part.

In an implementation variant, the opening of the tubular shock-absorbing element is oriented downwards. In this case, it is the portion of outer sole constituting the top of the tubular element that is in contact with the inner sole.

In one method of implementation of this variant, the bottom edge of the tubular element, at least on the side of its inner wall, is displaced in height in relation to the general pressure plane of the outer sole.

DETAILED DESCRIPTION

Figure 1:
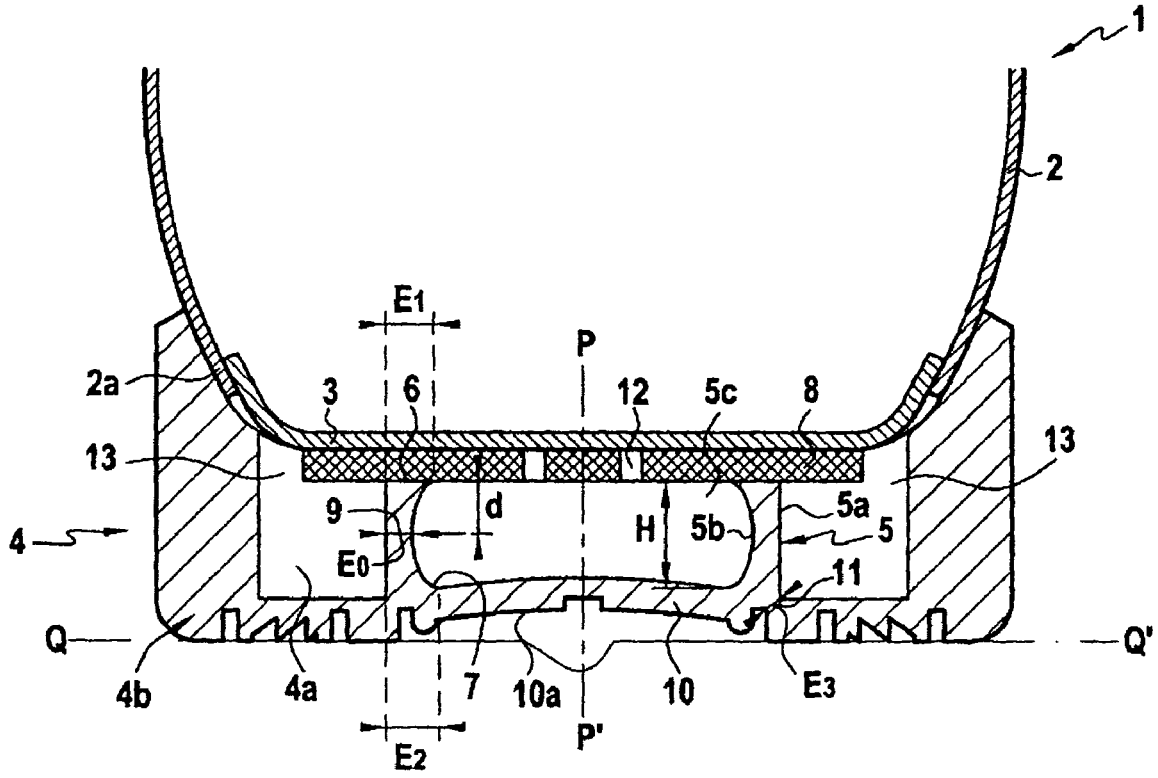
FIG. 1 is a schematic representation in section of the shoes of the first example, in a vertical plane passing through the axis of symmetry of the internal shock-absorbing element, corresponding to the vertical axis of the calcaneum.
Figure 2:
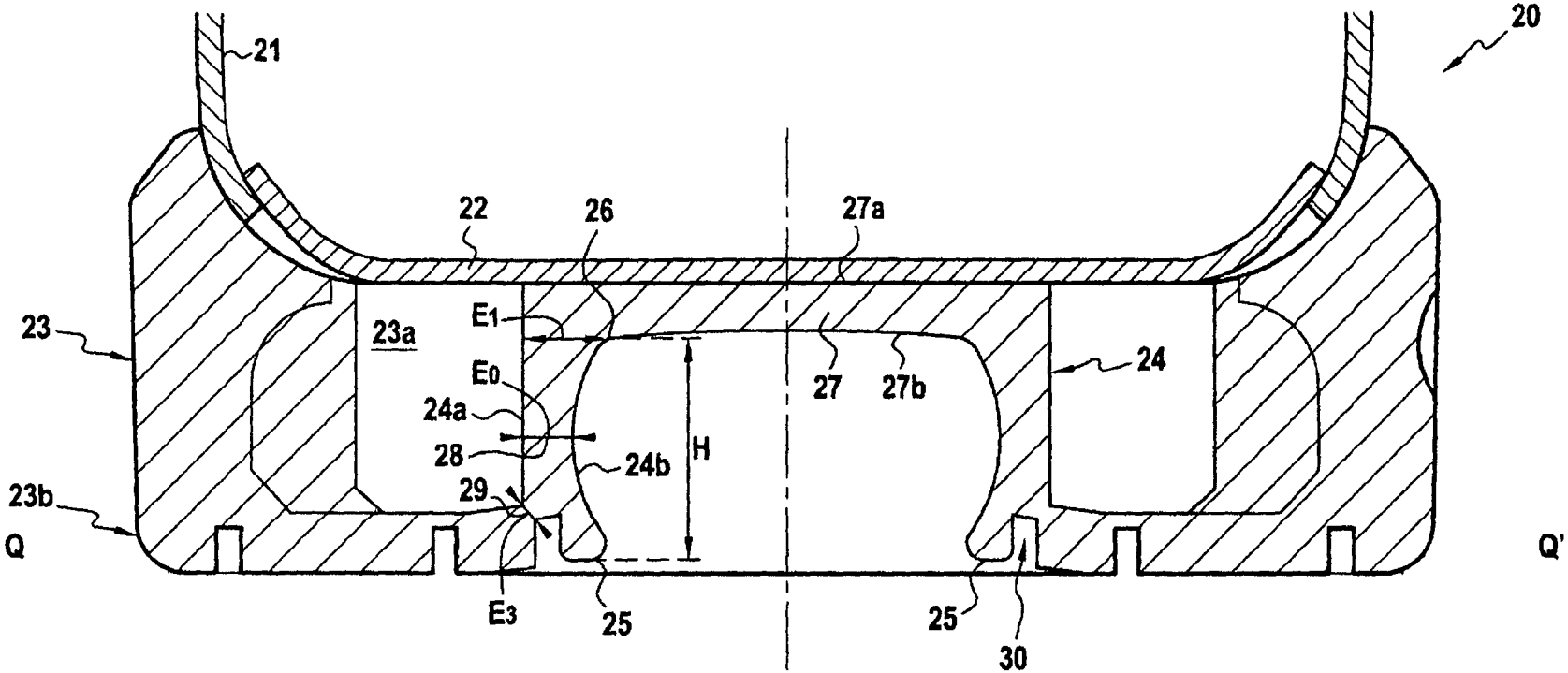
FIG. 2 is a schematic representation in section of the shoes of the second example, in a vertical plane passing through the axis of symmetry of the internal shock-absorbing element, corresponding to the vertical axis of the calcaneum.

This present invention will be understood more clearly on reading the description that follows of two examples of implementation of a shoe, which can be a sports shoe or a leisure town shoe, having an outer sole whose heel part is hollowed out with an opening directed upwards in the first example and downwards in the second example, where this shoe includes an internal shock-absorbing element forming a single block with the outer sole, of hollow tubular configuration. In the first example, the shoe also includes a flexible disk in a plastic material which at least partially closes off the opening in the heel part and which rests on the top edge of the shock-absorbing element. These two examples are illustrated in the appended drawing in which FIGS. 1 and 2 are schematic representations in section of the shoes of the first and second examples respectively, in a vertical plane passing through the axis of symmetry of the internal shock-absorbing element, corresponding to the vertical axis of the calcaneum.

According to the first example, the sports shoe 1 includes an upper 2, an inner sole 3 and an outer sole 4.

The outer sole 4 is in a material that is conventionally used for sports shoes, in rubber of 70 Shore A hardness for example. This outer sole has a heel part which has an inner space 4*a*, opening upwards, meaning toward the inner sole 3. In this inner space 4*a* is located a shock-absorbing element 5 which is made in a single piece with the outer sole 4, being created from the same material as the latter.

This shock-absorbing element 5 has a hollow tubular configuration which extends the base 4*b* of the outer sole 4 upwards, and which also opens upwards. This tubular element 5 is fitted in the inner space 4*a* with as its vertical axis of symmetry PP' the central axis of the calcaneum.

The shock-absorbing element 5 has a height H between its top edge 6 and its bottom edge 7, with the latter corresponding to its junction with the portion of the outer sole that closes off the shock-absorbing element across the opening. This shock-absorbing element has an annular cross section which is not of constant thickness over all of its height H. Locally, it has a zone 9 of reduced thickness E0, meaning less than the thickness E1 measured at its top edge 6, and preferably also than the thickness E2 measured at its bottom edge 7.

A flexible disk 8, made from an elastic material, rests on the top edge 6 of the shock-absorbing element 5, lying at least partially above the space 4*a* formed in the heel part of the outer sole 4.

In the example illustrated in FIG. 1, the disk 8 does not cover the whole of space 4*a*, so that there remains around the periphery of the said disk 8 an access opening 13 to the inner space 4*a* of the outer sole 4. The inner sole 3 totally covers the flexible disk 8 and opening 13, as well as the bottom end 2*a* of the upper 2 in part.

The flexible disk 8 can be fixed onto the top edge 6 of the shock-absorbing element 5, by glueing for example.

The outer wall 5*a* of the shock-absorbing element 5 is perpendicular to the general pressure plane QQ' of the outer sole. This general pressure plane QQ' corresponds to the plane of the inner face of the base 4*b* of the outer sole, which makes contact with the ground.

The inner wall 5*b* of the shock-absorbing element 5 has a concave curvature, so that the variation of thickness between the top edge 6 and the bottom edge 7 of the shock-absorbing element 5 is progressive, decreasing from the top edge 6 to the section corresponding to the zone 9 of reduced thickness E0 and then increasing to the bottom edge 7.

In one particular method of implementation, which is given by way of a non-exhaustive example, the radius of curvature of the concave inner wall 5*b* was of the order of 6 to 10 mm, the height H of the shock-absorbing element 5 was of the order of 13 to 15 mm, the thickness E1 at the top edge 6 was of the order of 4 to 5 mm, the thickness E0 in the zone of reduced thickness 9 was of the order of 2 to 3 mm, and the distance d between the zone of reduced thickness 9 and the top edge 6 was of the order of 5 to 6 mm.

In this example, the tubular element 5 had an ovoid cross section whose major longitudinal axis, along the general direction of the shoe, measured 42 mm, and the minor axis, visible in FIG. 1, measured 37 mm.

During the impact of the heel of the shoe on the ground, this impact occurring at the calcaneum, a deformation occurs firstly by flexing of the flexible disk 8 and secondly of the shock-absorbing element 5. The flexible disk 8 curves inwards toward the inner space 5*c* of the shock-absorbing element 5. The shock-absorbing element 5 deforms by flexing, from the zone of reduced thickness 9 toward the inner space 4*a* of the outer sole surrounding the shock-absorbing element 5. It is this double deformation, firstly vertical of the flexible disk 8 and secondly transversal of the shock-absorbing element 5, which absorbs the energy of the impact of the calcaneum transmitted by the inner sole 3.

In the example illustrated in FIG. 1, the portion of the base 4*b* of the outer sole 4 that constitutes the bottom 10 of the shock-absorbing element 5 has a slightly concave configuration, curving inwards toward the inner space 5*c* of the shock-absorbing element 5. In addition, the lower wall 10*a* of this bottom 10 is displaced in height in relation to the general pressure plane QQ' of the outer sole 4. These particular arrangements are made so that the double deformation described above cannot be subjected to any counter force, which could be due to the deformation of the bottom 10 for example, because of the increase in pressure which could occur in the inner space 5*c* of the shock-absorbing element 5 during the flexing of the flexible disk 8.

The junction 11 between the bottom 10 and the base 4*b* of the outer sole has a thickness E3 which is of the order of, or even less than, the thickness E0 of the zone of reduced thickness 9 of the shock-absorbing element 5, so as to facilitate the transverse flexing of the said shock-absorbing element 5.

The flexible disk 8 is equipped with four through holes 12. During the impact of the heel part of the shoe on the ground, the inner sole 3 is applied with force onto the flexible disk 8 so that the through holes 12 are totally closes off, and the inner space 5*c* of the shock-absorbing element 5 acts as an air chamber, with an increase in the pressure generated by the deformation of the walls of the said chamber. On the other hand, when the foot is lifted, it is possible for the air to enter via the through holes 12 so that equilibrium is again restored during the progressive return of the flexible disk 8 to its normal position.

In one particular, though not exclusive, method of implementation of this first example, the flexible disk 8 was a rubber disk with a thickness of 3 mm and a Shore A hardness of 63 to 73, preferably 68.

The flexible disk 8 can possibly be incorporated into the inner sole 3.

In the second example, which is illustrated in FIG. 2, the sports shoe 20 includes an upper 21, an inner sole 22 and an outer sole 23 which is in a conventional material used for sports shoes, in rubber with a Shore A hardness of 70 for example. This outer sole has a heel part with an inner space 23*a* opening upwards, meaning toward the inner sole 22. In this inner space 23*a* is located a shock-absorbing element 24 which is made in a single piece with the outer sole 23, being made of the same material as the latter.

This shock-absorbing element 24 has a hollow tubular configuration which extends the base 23*b* of the outer sole 23 upwards, and which is open downwards, meaning toward the ground when the shoe is worn by the user and resting on the ground. This tubular element 24 is fitted in the inner space 23*a* with as its vertical axis of symmetry the central axis of the calcaneum.

The shock-absorbing element 24 has a height H between its bottom edge 25 and its top edge 26 which corresponds to its junction with the portion of the outer sole that closes off the shock-absorbing element 24 across the opening, the portion 27 on the upper face 27*a* of which rests the inner sole 22. This shock-absorbing element 24 has an annular cross section which is not of constant thickness over all of its height H. Locally it has a zone 28 of reduced thickness E0, meaning less than the thickness E1 measured at its top edge 26.

The outer wall 24*a* of the shock-absorbing element 24 is perpendicular to the general pressure plane QQ' of the outer sole. This general pressure plane QQ' corresponds to the plane of the inner face of the base 23*b* of the outer sole, which makes contact with the ground.

The inner wall 24*b* of the shock-absorbing element 24 has a concave curvature, so that the variation of thickness between the top edge 26 and the bottom edge 25 of the shock-absorbing element 24 is progressive, decreasing from the top edge 26 to the section corresponding to the zone 28 of reduced thickness E0 and then increasing to the bottom edge 25.

During the impact of the heel of the shoe 20 on the ground, this impact occurring at the calcaneum, a deformation is achieved by flexing of the shock-absorbing element 24, from the zone 28 of reduced thickness toward the inner space 23*a* of the outer sole 23 surrounding the shock-absorbing element 24.

In the example illustrated in FIG. 2, the portion of the outer sole 24 that constitutes the top 27 of the shock-absorbing element 24 has an inner face 27*b* with a slightly concave configuration, so that during the impact which occurs at the vertical axis of the calcaneum, the top 27 of the shock-absorbing element 24 tends to flex preferentially in the central zone of reduced thickness. The shock-absorbing effect of the heel therefore results from this double deformation of the shock-absorbing element 24.

In addition, in the example illustrated in FIG. 2, the bottom edge 25 of the shock-absorbing element is displaced in height in relation to the general pressure plane QQ' of the outer sole 23. In addition the junction 29, between the shock-absorbing element 24 and the base 23*b* of the outer sole 23 has a thickness E3 which is of the order of, or even less than, the thickness E0 of the zone 28 of reduced thickness of the shock-absorbing element 24 so as to facilitate the transverse flexing of the said shock-absorbing element 24. This junction 29, of reduced thickness, can be achieved by means of a groove 30 formed in the thickness of the shock-absorbing element 24 from its bottom edge 25.

In the two examples above, the tubular shock-absorbing element is made in a single piece with the outer sole, since this greatly simplifies the manufacturing process. This feature is not exclusive, and the shock-absorbing element can also be a separate element in the heel part hollowed out of the outer sole, particularly made of a material that is different from that of the outer sole.

The invention claimed is:

1. A sports shoe, comprising:

an inner sole and an outer sole;

a hollow heel part with an opening facing upwards and including an internal shock-absorbing element, wherein the shock-absorbing element, forms a single block with the outer sole, has a hollow tubular open configuration, and an annular section, having an overall height which is not of constant thickness over all of its height thereof so that it locally presents a zone of reduced thickness where flexing of the shock-absorbing element occurs by deformation.

2. A shoe according to claim 1, wherein an outer wall of the shock-absorbing element is perpendicular to a general pressure plane of the outer sole and an inner wall thereof has a concave curvature.

3. A shoe according to claim 2, wherein a radius of curvature of the concave inner wall is 6 to 10 mm.

4. A shoe according to claim 1, wherein the opening of the tubular shock-absorbing element is directed upwards, and the shoe includes a flexible disk comprised of a plastic or rubber material that at least partially closes off the opening of the heel part and rests on the top edge of the shock-absorbing element.

5. A shoe according to claim 4, wherein a portion of the outer sole comprises a bottom of the shock-absorbing element and has a concave configuration.

6. A shoe according to claim 4, wherein a portion of the outer sole comprises a bottom of the shock-absorbing element and is displaced in height in relation to a general pressure plane of the said outer sole.

7. A shoe according to claim 4, wherein the flexible disk is a plastic material and is pierced with at least one through hole.

8. A shoe according to claim 4, wherein the shock-absorbing element has a height measured at its outer wall of 13 to 15 mm, a thickness of 4 to 5 mm at its top edge, and a thickness of 2 to 3 mm in the zone of reduced thickness.

9. A shoe according to claim 8, wherein the zone of reduced thickness is at a distance from the top edge of the shock-absorbing element of 5 to 6 mm.

10. A shoe according to claim 4, wherein the flexible disk is rubber and has a thickness of 3 mm.

11. A shoe according to claim 4, wherein a junction between a portion of the outer sole comprising a bottom of the shock-absorbing element and a base of the outer sole has a thickness of, or less than, the thickness of the zone of reduced thickness of the shock-absorbing element.

* * * * *